United States Patent [19]

Schreiber et al.

[11] 3,951,236

[45] Apr. 20, 1976

[54] MOUNTABLE HOIST

[76] Inventors: Raymond H. Schreiber, 3242 Beals Branch Road; James Lamont Hagan, Jr., 5520 Indian Oaks, both of Louisville, Ky. 40207

[22] Filed: Dec. 20, 1974

[21] Appl. No.: 534,673

[52] U.S. Cl. ..... 187/2; 182/145; 187/11; 248/230

[51] Int. Cl.[2] ..... B66B 9/18

[58] Field of Search ..... 187/2, 6, 8, 9 R, 9 E, 187/11, 17, 20, 27, 95; 182/141, 142, 145, 146; 52/118, 121; 403/49, 78, 292, 293, 286, 300; 248/70, 74 R, 230

[56] References Cited

UNITED STATES PATENTS

| | | | |
|---|---|---|---|
| 464,900 | 12/1891 | Schwannecke | 187/8 |
| 936,911 | 10/1909 | Klaus | 187/11 |
| 1,235,943 | 8/1917 | Smith | 187/9 R |
| 1,501,991 | 7/1924 | Giudice | 187/11 |
| 1,773,030 | 8/1930 | Connely | 187/95 X |
| 1,981,938 | 11/1934 | Anderson | 187/95 X |
| 2,122,908 | 7/1938 | Collins | 187/6 |
| 2,761,574 | 9/1956 | Harlan | 187/11 X |
| 3,213,574 | 10/1965 | Melbye | 52/121 |
| 3,276,546 | 10/1966 | Slais | 187/2 |
| 3,313,376 | 4/1967 | Holland | 187/2 |

*Primary Examiner*—Evon C. Blunk
*Assistant Examiner*—James L. Rowland

[57] ABSTRACT

A hoist having an outer principal channel post and an inner secondary channel member, longitudinally movable therewithin, the secondary channel member being moved by a winch and cable and being adapted to travel longitudinally beyond the upper end of the principal channel post to allow heavy items to be elevated to a position in abutting relationship to, for example, a ceiling or roof. The hoist can be easily mounted to either the inside or the outside of a conventional pipe scaffolding to provide for the raising and lowering of building materials.

5 Claims, 7 Drawing Figures

MOUNTABLE HOIST

BACKGROUND OF THE INVENTION

It has been a long felt need of builders and construction workers to have a hoist which is simple to construct, easy to use, and convenient to store. It has further been a long felt need to have a hoist which is capable of raising a heavy load, for example, an air conditioner or heavy pipe to the precise position it is to be in when installed.

Prior art attempts at providing such a hoist are represented by the following U.S. patents hereinafter discussed:

U.S. Pat. No. 3,276,546 — Slais shows a knock-down building material elevator. However, the Slais arrangement does not allow for a heavy item to be raised to a position flush with a ceiling or roof, since the motor and drive means are located at the top of the sectional column. Further the Slais arrangement is expensive in that it includes a carriage having six rollers to facilitate movement of the hoist platform longitudinally up and down. Also the Slais arrangement is difficult to use in the sense that, in order to increase its height, one must remove a very heavy motor and drive means atop the scaffold and add an additional segment to the column and then re-attach the motor and drive means on top of the new segment. All of this would be accomplished at a very considerable height above the ground or floor as building proceeds.

Holland — U.S. Pat. No. 3,313,376 shows a light weight elevator attachable to a scaffold. However, Holland, like Slais suffers from several disadvantages. One such disadvantage is that the motor of Holland is attached to the elevator platform adding additional weight thereto. Also the Holland arrangement requires an electrical supply cord to be attached thereto to the elevator platform and reciprocate therewith. Another disadvantage is that control of the elevator must be remote from the moving motor and drive means. And finally Holland must, by necessity, employ rollers on his platform to facilitate its movement longitudinally on the track.

One additional prior art patent which deserves mention is U.S. Pat. No. 936,911 — Klaus et al. Klaus describes a portable hoist for putting ice into ice boxes. Klaus does not, however, provide the facility to bring his platform to a position above the upper end of his hollow mast. Thus he is not able to lift articles into a position above the top of the mast. Also, Klaus does not provide an arrangement having an inner secondary channel to provide a large load bearing surface to allow large heavy loads to be lifted, as will be discussed hereinafter with respect to the present invention. The present invention overcomes the above mentioned prior art defects and provides a straightforward inexpensive, easily constructed and readily maintained movable hoist.

SUMMARY OF THE INVENTION

The invention includes a mountable hoist which is capable of being attached to either the inside or the outside of a construction scaffold to allow articles to be lifted thereby to any desired height including a height above the top of the hoist's principal channel member. The hoist is inexpensive to build and easy to erect. It allows heavy objects to be lifted adjacent a ceiling or roof, thereby eliminating the need for workmen to lift heavy objects the last few inches to put them in operating position.

More specifically the invention includes: A mountable hoist designed to be easily affixed to the outside, or in the alternative, the inside of a scaffolding structure. The hoist comprises: an outer principal channel member having a longitudinal slot in one side extending the entire length thereof.

An inner, secondary channel member of geometry comforming to the outer channel and sized to be movably received within the interior of the outer channel, for free sliding movement in a longitudinal direction relative thereto, the secondary channel also having a longitudinal slot in one side extending at least a portion of the length of one side, the slot containing side of the secondary channel being diametrically opposed to the slot containing side of the principal channel when the principal and the secondary channels are in assembled relationship;

- a carriage removably mounted to the secondary channel by mounting means extending through the longitudinal slot in the principal channel, the carriage thereby moving simultaneously with the secondary channel in a longitudinal direction over the entire height of the principal channel;
- a pulley means mounted to the principal channel at its upper end;
- a tension means cooperable with the pulley means and extensible within the principal channel and attached interiorly of the secondary channel at a point below its uppermost end, the tension means being sized to pass through the slot in the secondary channel to permit the secondary channel to project above the uppermost end of the principal channel;
- drive means for applying tension to the tension means to effect movement of the carriage.

The hoist of this invention has been found to be a useful impliment for lifting heavy articles to a desired height adjacent a pipe scaffold.

DESCRIPTION OF THE PREFERRED EMBODIMENT

Figure 1:
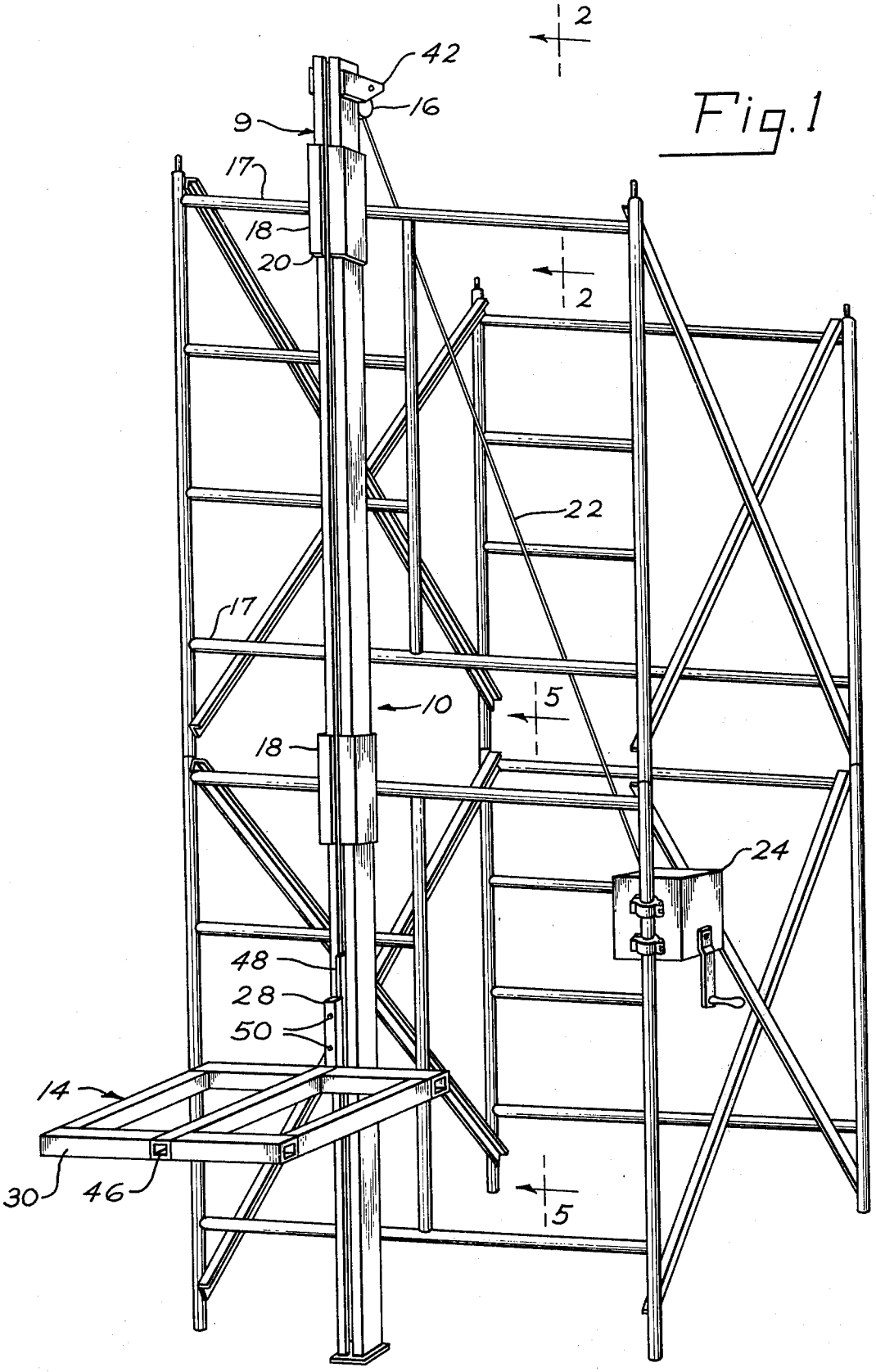
FIG. 1 is a perspective view of the hoist of this invention attached to the outside of a pipe scaffold.

Mountable hoist 9 includes a principal channel 10 and a secondary channel 12 movably mounted therein. Principal channel 10 is preferably a segmented channel member which can be increased in height to correspond to the level of the scaffold associated therewith. The segments are held in end to end abutting relationship by support sleeves 18 which are in turn fastened to selected pipes 17 of the scaffold.

Figure 4:
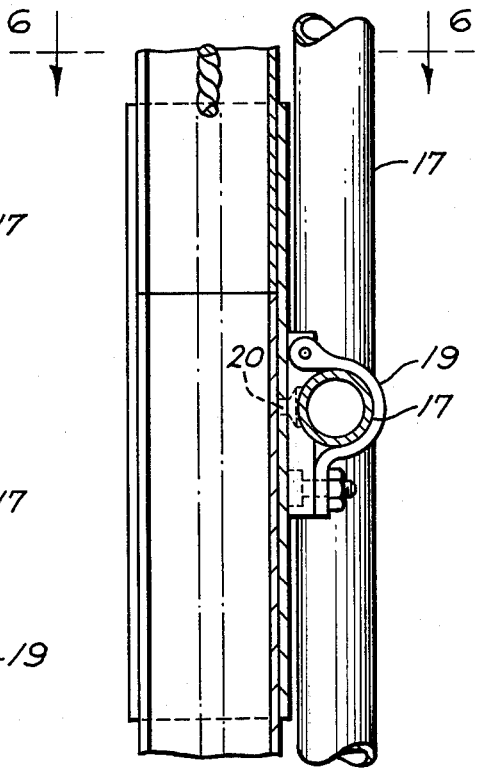
FIG. 4 is a partial cutaway view showing the means of attaching the hoist to the scaffold.
Figure 6:
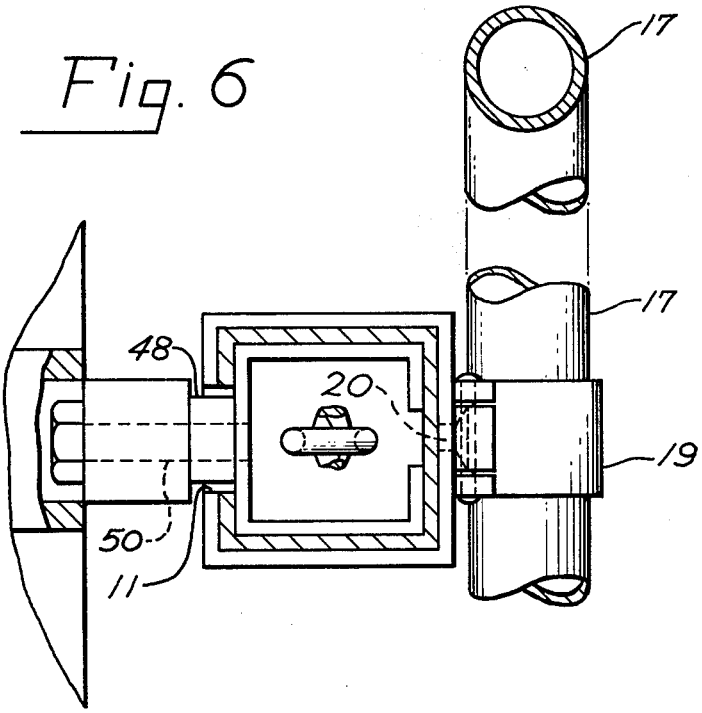
FIG. 6 is a view taken along line 6—6 of FIG. 4.

The support sleeves 18 are best seen in FIGS. 4 and 6. Each includes a pipe clamp 19 attached by swivel mounts 20 to the sleeve body. Such an arrangement allows the sleeves to be attached to either horizontally or vertically oriented scaffold pipes. Therefore, the hoist may be readily attached to the inside, the outside or a corner of the scaffold structure shown in FIG. 1. Note that when the hoist is attached to the corner pipes of the scaffold it is readily accessible from more than one direction. Also note that the support sleeves 18 are sized to be slipped onto the principal channel at any desired spacing so that additional support may be provided thereto in the event that particularly heavy loads are to be handled. In addition swivel mounts 20 can be movably attached to sleeves 18 to facilitate use of the hoist on various sized scaffolds.

Generally channel 12 is of sufficient length to provide a substantial interface between its outer surface and a portion of the inner surface of principal channel 10. This interface must be of sufficient surface area to adequately resist the torque loading on the platform 30 without pulling outwardly from inside channel 10. Also the interface of the two channels should be sufficiently large so as to prevent gouging or cutting of the secondary channel into the primary channel as the platform is loaded. Generally it has been found that the size of the secondary channel must be approximately equal in height to the standard 28 of the L-shaped support arm 34. Such sizing provides a sufficiently large interface so that the secondary channel cannot be rotatedly pulled downwardly and outwardly from its operational position within principal channel 10.

The particular sizing of the secondary channel is important for still another reason. It is important that the secondary channel be large enough so that rollers need not be used thereon to permit the drive means to move the carriage up and down. A properly sized secondary channel obviates the need for rollers to be located thereon in contact with the inner surface of the principal channel. Thus proper sizing of the secondary channel makes the hoist less expensive and easier to maintain.

Figure 2:
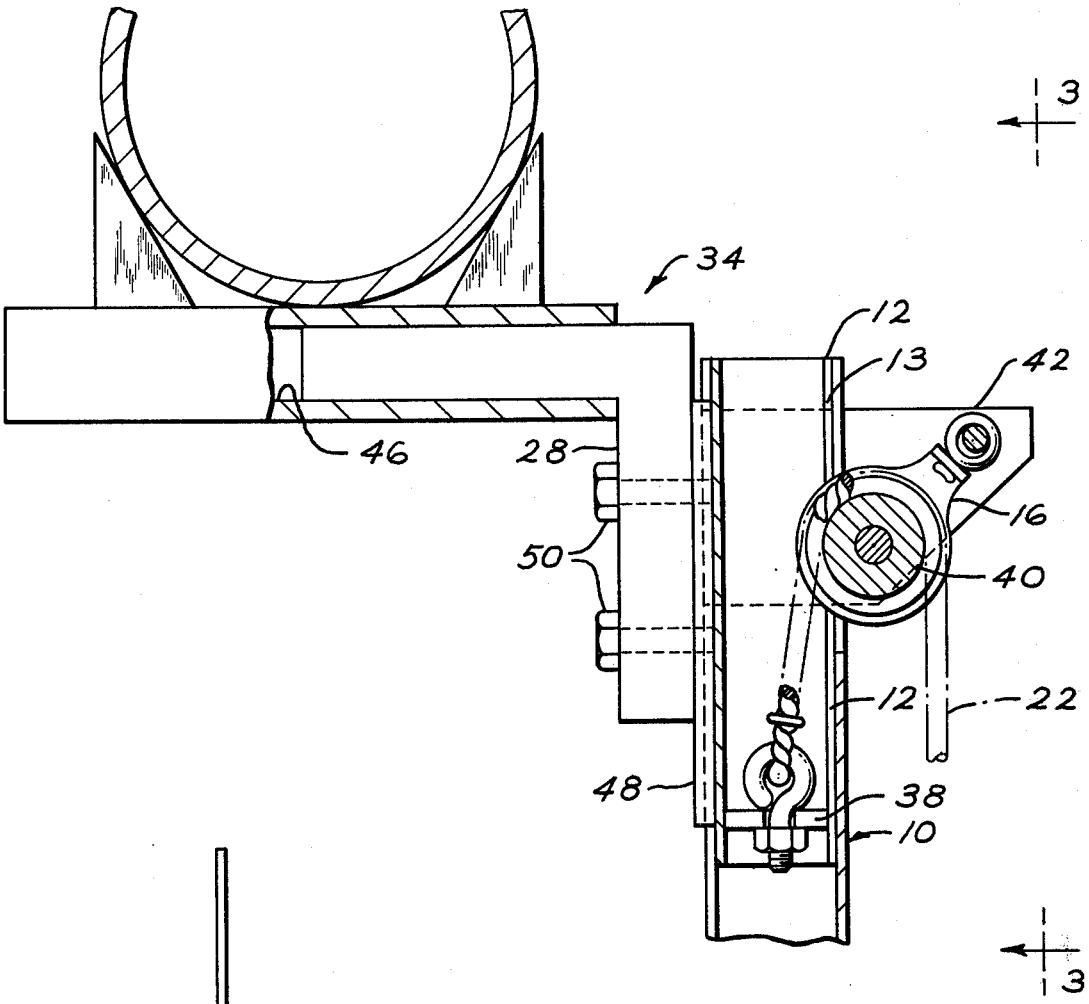
FIG. 2 is a partial cutaway view of the carriage of the hoist shown projecting above the top of the principal channel of the hoist.

Secondary channel 12 has a cable attachment means 38 affixed within its interior. This cable attachment means must be located in such a manner that the end of cable 22 is below the upper end of the secondary channel. Thus when the attachment means is adjacent the pulley sheave 40 the carriage will be in a position above the end of principal channel 10 as shown in FIG. 2. It is important to note in FIG. 2 that a portion of pulley means 16 projects inwardly through the longitudinal slot 13 in the secondary channel 12 so that secondary channel 12 and thus carriage 14 can project above the top of principal channel 10.

Figure 3:
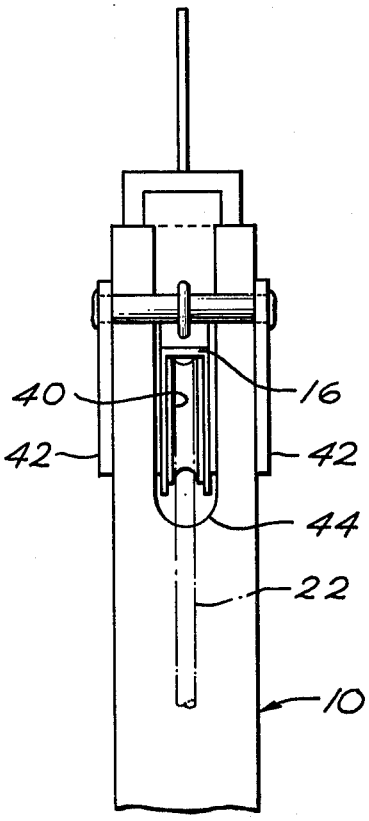
FIG. 3 is a view taken along line 3—3 of FIG. 2

In the embodiment of FIG. 2 pulley support 42 is provided to support pulley means 16 in operating position at the end of principal channel 10 in a manner such that cable 22 may extend down the center of thereof without rubbing on its sides. In this instance there is a cutaway portion 44 (best seen in FIG. 3) which allows pulley means 16 to pass through the backside of principal channel 10. It should be appreciated that it would be possible to arrange pulley support 42 so that it holds pulley 16 above the top of principal channel 10 thus obviating the need for cutaway portion 44. It would under such circumstances, however, still be necessary to provide slot 13 in channel 12 so that cable 22 would pass therethrough to allow the upper end of channel 12 and thus carriage 14 can be raised to a point above the upper end of principal channel 10.

In this regard pulley means 16 may be provided with a swivel attachment to pulley support 42 so that it becomes self-aligning and readily straddled by the opposed edges of slot 13 in secondary channel 12 during the lifting operation.

Figure 5:
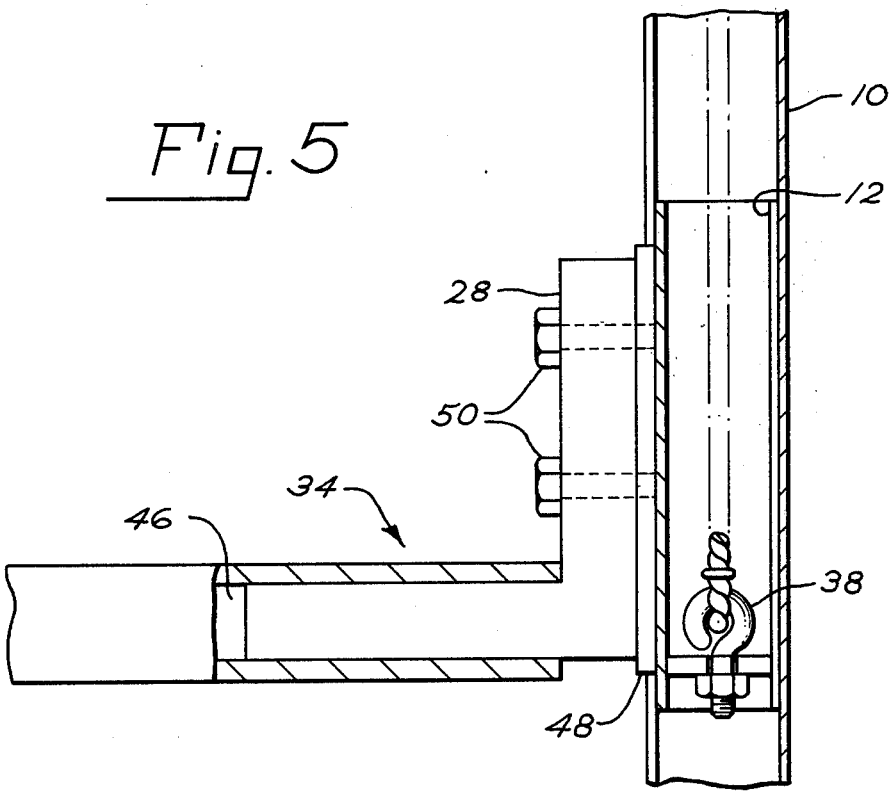
FIG. 5 is a partial cross-sectional view showing an alternative arrangement of the carriage attached to the secondary channel.

As can be seen from FIGS. 2 and 5, L-shaped support arm 34 can be attached in either an upright or inverted position depending upon whether it is desired to have the capacity to lower platform 30 to a point flush with the ground or to raise it to a point above the upper end of primary channel 10.

Also as can be seen from FIGS. 2 and 5 the platform 30 may take a variety of shapes and sizes. Thus platform 30 may be equiped with an opening 46 for slidably receiving the base portion of L-shaped support arm 34. Thus, a hoist may have a number of platforms which are easily interchanged to fit the need.

It is also important to note that the L-shaped support arm 34 is attached to secondary channel 12 by fastening means such as spacer 48 and bolts 50. Spacer 48 projects through slot 11 and serves to keep the standard 28 of arm 34 from rubbing against the face of principal channel 10. Thus it can be seen that slot 11 is necessary so that the fastening means can extend therethrough and travel longitudinally as the carriage is raised and lowered.

It should be noted, however, that it may not be necessary under some circumstances to provide the hoist arrangement with spacer 48. It may in the alternative be sufficient to merely provide bolts 50 inserted but not tightened the fullest extent so that any frictional drag caused by pinching the primary channel 10 between the standard on one side and the secondary channel on the other side is minimal.

As was alluded to earlier a drive means such as winch 24 is provided as the means by which the carriage is moved longitudinally during the lifting operation. The winch can be either manually operated or motor driven. A manually operated winch is shown in FIG. 1. The winch can be located remote from the hoist itself and can be located at either the top or the bottom of the scaffold. It should be noted that the use of the winch in a position on either side of the principal channel does not affect the ability of the pulley means to fit between opposed edges of the slot 13 of the secondary channel 12 since both the slot and the interior of the channel are sufficiently large to permit the pulley means to fit therewithin even when it is slightly twisted with respect to its normal position when viewed in a horizontal plane from above the hoist.

As explained earlier a tension member such as cable 22 is fastened to the interior of channel 12 below the top portion thereof. Cable 22 runs up the inside of secondary channel 12 and principal channel 10 to pass through pulley means 16. Pulley means 16 is preferably located as shown in FIG. 2. In such a position cable 22 does not rub on any portion of the respective channels during the lifting operation. Cable 22 is, of course, wound upon a suitable drum (not shown) as part of winch 24. Various commercial winches will be found to be suitable for use in connection with the present invention. The winch may have, for example, a tapered drum for providing a continuous uniform drive rate in spite of the increase in drum diameter because of the accumulation of cable thereon as winding continues.

Figure 7:
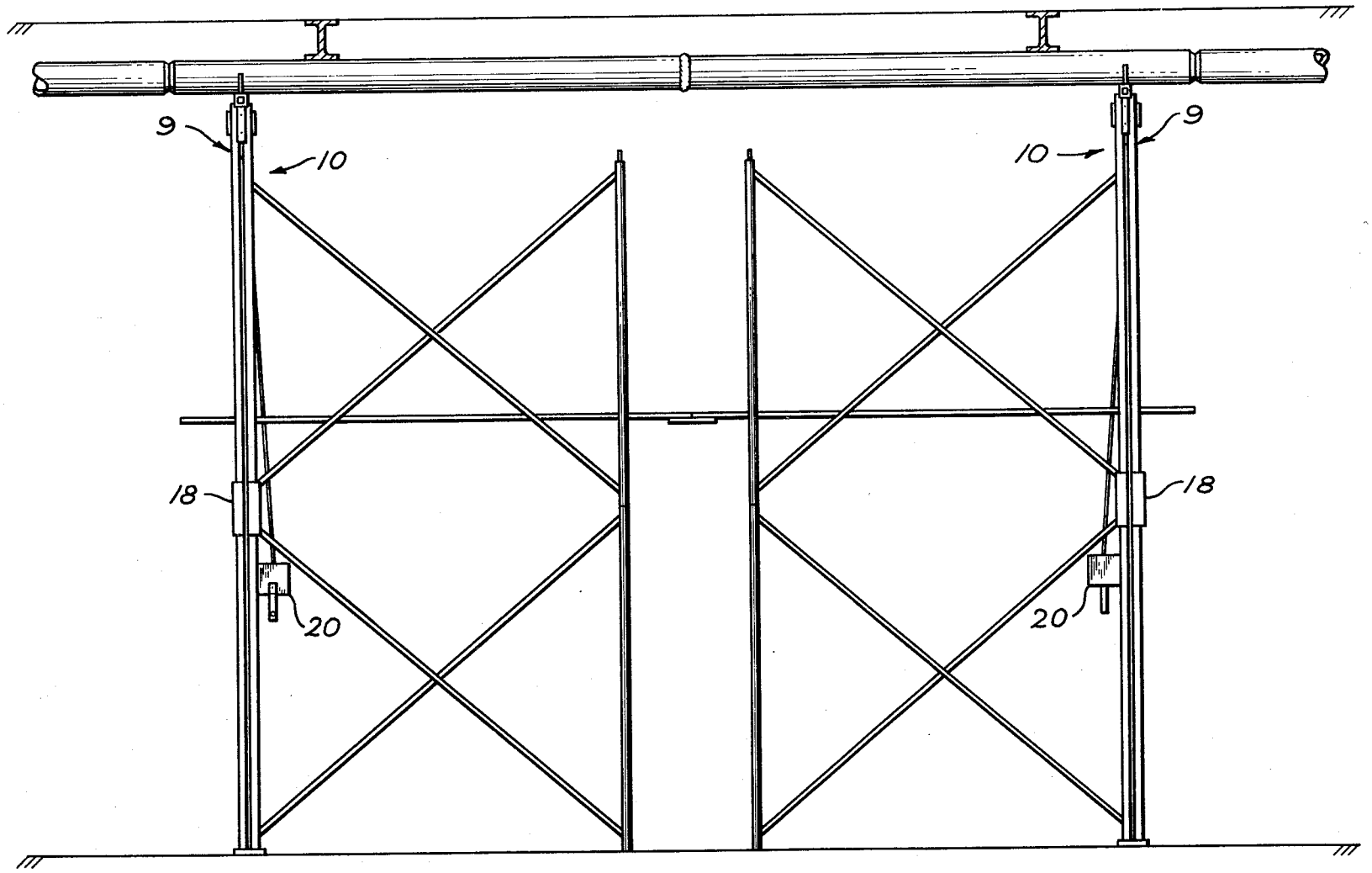
FIG. 7 is a view two hoists being used in tandem.

It should be noted that a plurality of hoists of this invention can be used in tandem as shown in FIG. 7 to lift long objects or to provide support means for boards or other platform material which can then be used by workmen as a movable platform for bricklaying and the like.

Having thus described the invention what is claimed is:

1. A mountable hoist designed to be easily affixed to the outside, and in the alternative, the inside of a scaffolding structure, the hoist comprising:

an outer principal channel member, having a longitudinal slot in one side extending the entire length thereof;

mounting means fitted exterior of said principal channel member, said mounting means including a channel shaped sleeve having a longitudinal slot in one side extending the entire length thereof and a swivel mount attached to said sleeve opposite said slot, said principal channel slot, and said sleeve slot being aligned to provide an opening into the interior of said principal channel;

an inner, secondary channel member of geometry conforming to said outer channel and sized to be movably received within the interior of said outer channel, for free sliding movement in a longitudinal direction relative thereto, said secondary channel also having a longitudinal slot in one side extending from the top at least a portion of the length of one side, said slot containing side of said secondary channel being diametrically opposed to said slot containing side of said principal channel when said principal and said secondary channels are in assembled relationship;

carriage means including a base and an L-shaped support arm, said arm having a vertical standard and being removably mounted to said secondary channel by mounting means extending through said longitudinal slot in said principal channel, said carriage thereby moving simultaneously with said secondary channel in a longitudinal direction over the entire length of said principal channel, said secondary channel being further described in that it is generally equal in height to said vertical standard;

a pulley means mounted to the principal channel at its upper end;

a tension means cooperable with said pulley means and extensible within said principal channel and attached interiorly of said secondary channel at a point below its uppermost end, said tension means being sized to pass through said slot in said secondary channel to permit said secondary channel to project above the uppermost end of said principal channel;

drive means for applying tension to said tension means to effect movement of said carriage.

2. The hoist of claim 1 wherein said pulley means projects partially into the interior of said principal channel and is positioned to be straddled by opposed sides of said slot of said secondary channel, thereby allowing said secondary channel to project longitudinally past said pulley means and beyond the end of said principal channel.

3. The hoist of claim 1 wherein said L-shaped support arm is provided with multiple attaching means so that it may be attached to said secondary channel in an inverted as well as an upright position and said base can be attached to one leg of said arm when in either upright or inverted position.

4. The hoist of claim 2 wherein said pulley means is pivotally attached to support means mounted adjacent the end of said principal channel member, said pivotal attachment allowing said pulley means to twist slightly thereby being self-aligning as it is straddled by opposed sides of the slot of said secondary channel.

5. The hoist of claim 1 wherein said drive means comprises a winch and said tension means comprises a cable.

* * * * *